US005357639A

United States Patent [19]

Zellner

[11] Patent Number: 5,357,639

[45] Date of Patent: Oct. 25, 1994

[54] BATH SEAT AND SPLASH SHIELD

[76] Inventor: John R. Zellner, 1610 King Ave., Kings Mills, Ohio 45034

[21] Appl. No.: 76,595

[22] Filed: May 13, 1993

[51] Int. Cl.[5] ..... A47K 3/12

[52] U.S. Cl. ..... 4/579; 4/605; 4/609

[58] Field of Search ..... 4/579, 578.1, 605, 609, 4/573.1, 589, 590

[56] References Cited

U.S. PATENT DOCUMENTS

| | | | |
|---|---|---|---|
| 2,725,576 | 12/1955 | Schwersinske | 4/609 |
| 3,984,880 | 10/1976 | Schrameyer | 4/609 |
| 4,472,844 | 9/1984 | Mace | 4/579 |
| 4,888,835 | 12/1989 | Baumann | 4/605 |
| 4,944,050 | 7/1990 | Shames et al. | 4/605 |
| 5,090,068 | 2/1992 | Zellner | 4/578.1 |

FOREIGN PATENT DOCUMENTS

| | | | |
|---|---|---|---|
| 382400 | 11/1964 | Switzerland | 4/579 |

*Primary Examiner*—Henry J. Recla
*Assistant Examiner*—Charles R. Eloshway
*Attorney, Agent, or Firm*—Robert J. Zellner

[57] ABSTRACT

An improved bathtub bathing system includes a bath seat and a splash shield which can be slipped into position with the bath seat in place on top of the bath tub. The seat overlays the front wall of the tub and the foot of the shield is secured in the desired position between the top of the tub wall and the seat. The shield is further located by a protrusion on the front of the shield which extends under the seat.

6 Claims, 1 Drawing Sheet

BATH SEAT AND SPLASH SHIELD

BACKGROUND OF THE INVENTION

As people grow older it becomes increasingly difficult for them to practice their daily hygene. To get up out of a bathtub requires assistance; to stand without help to shower invites a dangerous fall. Use of a bathing seat such as that shown in U.S. Pat. No. 5,090,068 is one solution to this problem, but unless the bather is careful, water cascading off the body frequently escapes the tub. A conventional practice when using the bathing seat is to tuck the shower curtain beneath the seat but many elderly, e.g. those with arthritic fingers, lack sufficient dexterity to do this properly, Moreover, with further advancing age the seated bather becomes less agile, and often experiences difficulty in placing the shower curtain to restrict splashing water from the bathroom floor. Any splash creates a slippery condition or at least an objectionable wet situation.

SUMMARY OF THE INVENTION

It is an object of this invention, therefore, to provide a bath seat and splash shield for use with a bath tub having a front wall and a back wall. The seat, which fits over the bath tub, has a top and a front. Support means extend beneath the seat front to hold its lower edge above the tub front wall to permit water running off the seat to enter the tub. In one embodiment the support means comprises a pair of blocks, each having a finger extending downward to contact the inside of the tub front wall.

A splash shield used in combination with the seat has an upright portion spaced from the seat front to catch the water running off the seat and direct it to the tub. The shield also cooperates with the front of the seat to form a passage to guide and restrain a shower curtain in a water-deflecting position. In one embodiment the shield has a horizontal foot which is adapted to rest against the top of the tub front wall and beneath the support means, the upright portion of the shield being separated from the front of the seat and substantially parallel to it to form a gap to receive runoff water and to guide a shower curtain.

In a preferred embodiment, the foot of the splash shield has a protrusion to extend between the support blocks. In another embodiment the upright portion of the shield extends to a height of between about 36 to about 48 inches above the bathroom floor to deflect splashing bath water from a caregiver who stands behind the shield while assisting the bather. In an alternate embodiment the upright portion of the splash shield extends to a height about even with the top of the seat which enables a bather to transfer from a standing position on the bathroom floor to a seated position on the seat while the shorter bath shield is in place. The taller shield is readily interchangable with the shorter one as their foot portions are identical.

These and other objects of the invention will be understood from reference to the following detailed description and the drawings wherein:

THE DRAWINGS

DETAILED DESCRIPTION

Figure 1:
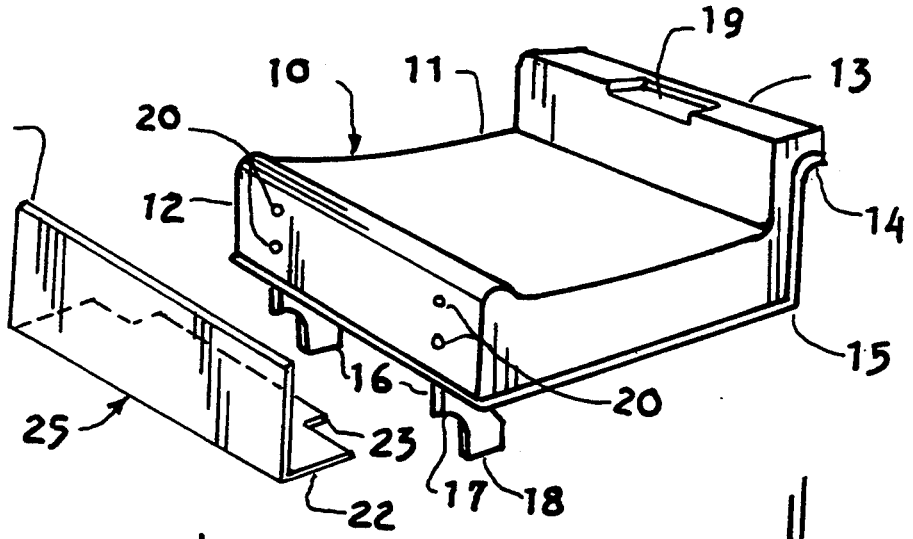
FIG. 1 shows a splash shield of this invention for use in combination with the illustrated bathing seat.
Figure 2:
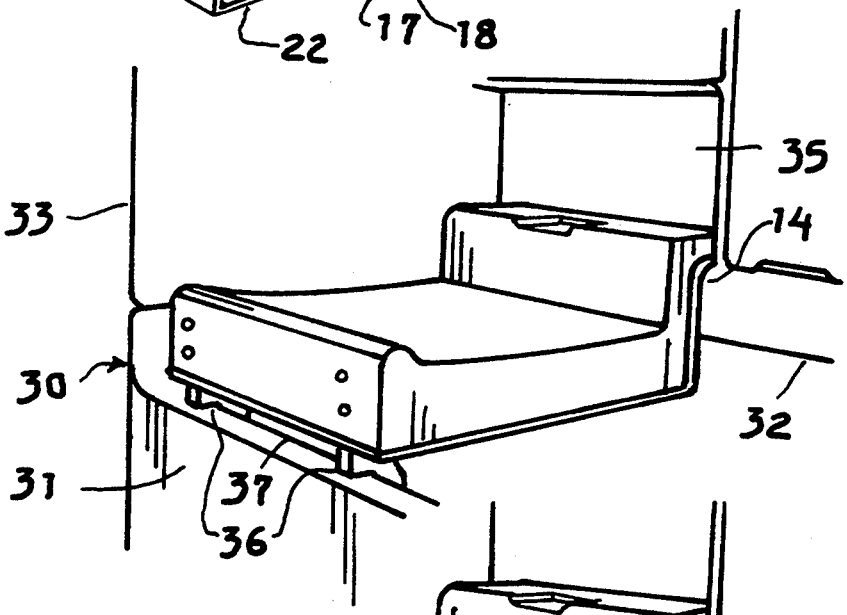
FIG. 2 is a view of the bathing seat, without the splash shield, in place on a bathtub, only part of which is shown.

With reference to FIG. 1, there is shown a bath seat generally 10 having a top 11, a front 12, a rear 13, and a bottom 15. The seat may be made of gel coat fiberglass or reinforced acrylic or other suitable material. When in place on a tub, the seat bottom 15 rests on the top of the back wall of the tub for support, or alternatively, the overhang 14 may engage a recess in the tub surround for support as shown in FIG. 2. Inside the front 12 of the seat are supports 16, of an engineering plastic, for example, which have a land 17 to engage the top of the front wall of the tub. Fasteners 20 secure the supports to the front of the seat. Extending down from each support is a finger 18 to engage the inner side of the front wall of the tub and assist in locating the seat. A soap holder 19 may be molded into the back of the seat.

The splash shield 25 has an upright member 21 and a foot 22. A protrusion 23 extends from the foot and serves to locate the shield when inserted between the supports 16. The shield is made of aluminum sheet or other suitable material. It may be finished in a color to match the seat and/or the tub.

In FIG. 2 the seat is shown in place on a tub, only parts of which appear. Illustrated in this view is the tub 30 and its front wall 31 and back wall 32. The tub surround 33 has a recess 35 in its back wall which is shown in engagement with the seat overhang 14. The support blocks 16 rest on the top of the tub wall at interface 36 so that a passage 37 remains beneath the seat for any splashed water to enter the tub.

Figure 3:
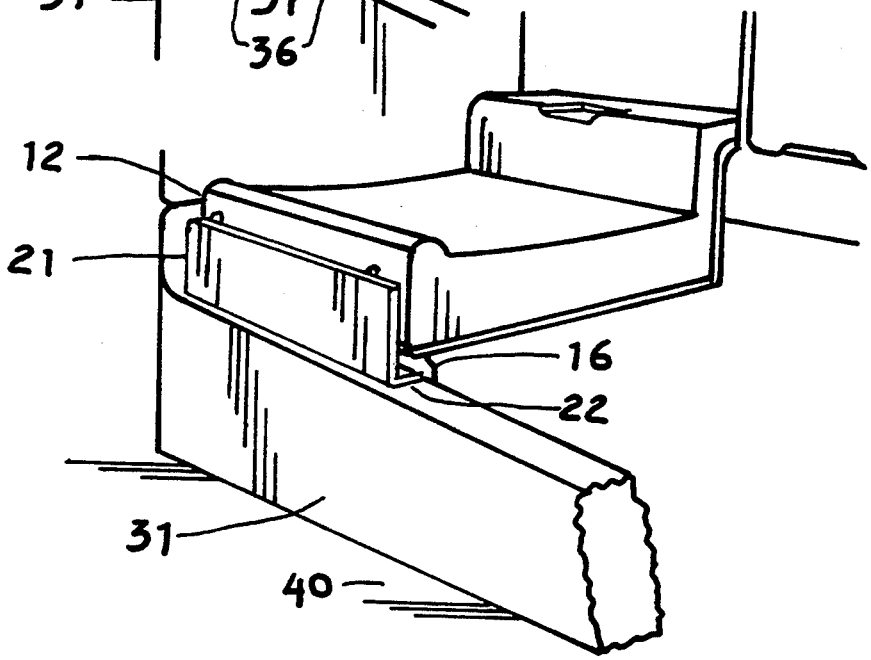
FIG. 3 shows a bathing seat and shield in place on a bath tub and surround, only parts of which are shown.

In FIG. 3 the splash shield is shown with its foot 22 secured at the interface between the top of the front tub wall 31 and the support blocks 16. The support blocks may be relieved over a portion of the end adjacent the top of the tub wall. The relief is slightly greater than the maximum thickness of the shield foot so that the shield can be slipped into place without lifting the seat. The upright portion 21 of the shield is substantially parallel to the front 12 of the seat and spaced from it a distance between about one to about four inches. In a preferred embodiment the space is from about one inch to about two inches. In the embodiment illustrated the top of the shield is below the level of the seat top so that a bather may assume a seated position on the seat from a standing position on the bathroom floor 40. The shield could be somewhat higher than shown, but for this embodiment its maximum height should be about equal to height of the seat top.

In using the shorter shield, the bather would transfer from a standing position on the bathroom floor or from a wheel chair to a seated position on the seat and then place his or her feet inside the tub. If a shower curtain is used, it would then be slid through the opening between the seat and the shield so any water impacting the curtain will run down the inside of the curtain and into the tub via the passsage 37 under the seat.

In some instances, the bather may have a disability or be so mobility impaired that the shower curtain cannot be manipulated or the bather may require the assistance of a caregiver. In that situation, a shield may be employed with an upright member extending to a height of between about 36 to about 48 inches above the bathroom floor. In such a case the caregiver may lean against the outside of the shield while assisting the bather and yet be protected from splashing bath water.

The embodiments described above and illustrated in the drawings are, of course, to be regarded merely as non-limiting examples and as to their details may be modified in several ways within the scope of the following claims.

What is claimed is:

1. In a bathing system including a bathtub on a bathroom floor, said bathtub having a front wall and a back wall, said front wall including a top and an inner side, the combination comprising a removable bath seat having a front overlying the tub front wall, and a splash shield wherein said splash shield has a foot in slidable engagement with the top of the tub front wall and extending horizontally beneath the seat front, said shield having an upright portion extending upwardly from the top of the tub front wall and spaced from the seat front to direct splashed water into the tub and to form a passage to accept a shower curtain.

2. The combination of claim 1 including seat support means fastened to the seat front and extending beneath the seat front to hold the seat front above the tub front wall and wherein the splash shield foot rests upon the top of the tub front wall and beneath the support means, the upright portion of the splash shield being spaced from the front of the seat and substantially parallel to it.

3. The combination of claim 2 wherein the support means comprises a pair of blocks, and on each block, a finger extending downward to contact the inside of the tub front wall.

4. The combination of claim 3 wherein the foot of the splash shield has a protrusion extending between the support means.

5. The combination of claim 1 wherein the upright portion of the splash shield extends to a height of between about 36 to about 48 inches above the bathroom floor.

6. The combination of claim 1 wherein the upright portion of the splash shield extends to a height not above the seat.

* * * * *